United States Patent [19]

Bankier et al.

[11] Patent Number: 4,749,295

[45] Date of Patent: Jun. 7, 1988

[54] FAN-FOLD PAPER CATCHER FOR A PRINTER

[75] Inventors: Jack D. Bankier, Northbrook, Ill.; Kenneth J. Muderlak, Shorewood, Wis.

[73] Assignee: Bankier Companies, Inc., Northbrook, Ill.

[21] Appl. No.: 17,340

[22] Filed: Feb. 20, 1987

Related U.S. Application Data

[63] Continuation-in-part of Ser. No. 813,581, Dec. 26, 1985.

[51] Int. Cl.[4] ..... B41J 11/58

[52] U.S. Cl. ..... 400/613.2; 400/619; 312/208

[58] Field of Search ..... 400/613.2, 613.3, 613.4, 400/642, 619; 312/39–40, 208; 493/410–413, 409; 270/39–40

[56] References Cited

U.S. PATENT DOCUMENTS

| | | | |
|---|---|---|---|
| 1,675,436 | 7/1928 | Waldheim | 400/613.2 X |
| 2,348,059 | 5/1944 | Daly | 400/613.2 X |
| 3,712,607 | 1/1973 | Ziegler et al. | 270/39 |
| 4,107,700 | 8/1978 | Jornod | 400/613.2 X |
| 4,568,212 | 2/1986 | Cooke et al. | 312/208 |
| 4,631,552 | 12/1986 | Kobayashi | 400/613.2 X |
| 4,681,468 | 7/1987 | Kallin et al. | 400/613.2 X |
| 4,707,156 | 11/1987 | Clark | 400/613.2 |

*Primary Examiner*—Eugene H. Eickholt

*Attorney, Agent, or Firm*—Hill, Van Santen, Steadman & Simpson

[57] ABSTRACT

A paper catcher for a printer comprises a stand which may include a shelf, or supporting printer, a basically flexible duct forming an infeed chute and including lower flexible fingers for supporting the lower surface of the paper coming from the printer and a pivotal upper member for writing on the paper to prevent buckling. The paper then travels through a reversal chute and exits under the influence of a member riding thereon which overcome the natural tendency for the fan-fold paper to buckle upwardly instead of downwardly for depositing onto a paper collection tray mounted above and at an angle spaced from the printer so that the printer material may be read as it is being printed on the platen of the printer.

24 Claims, 5 Drawing Sheets

52
54
112
VIII
VIII
84
80
82
92
90
48
18
X
X
88
118
58
86
106
110
98
100
120
114
116

FAN-FOLD PAPER CATCHER FOR A PRINTER

CROSS REFERENCE TO RELATED APPLICATION

This application is a continuation-in-part of application Ser. No. 813,581, filed Dec. 26, 1985 and entitled "Fan-Fold Paper Catcher for a Printer".

BACKGROUND OF THE INVENTION

1. Field of the Invention

The present invention relates to a paper catcher for fan-fold paper output from a printer, and is more particularly concerned with the prevention of jamming of the paper as it is guided to a collection station and providing a paper catcher which may be easily folded for storage.

2. Description of the Prior Art

As pointed out in the application Ser. No. 813,581, filed Dec. 26, 1985, when a printer outputs printed paper, such as fan-fold paper, a problem arises as to the collection, stacking and the like of the paper. Heretofore, the paper was essentially guided to the rear of the machine and deposited on a table, on the floor or in a bin located at the rear of the machine, and more recently above the machine. These techniques lead to problems in the proper folding and stacking of the printed paper and to problems with respect to jamming of the fan-fold paper in the paper guide mechanism.

SUMMARY OF THE INVENTION

It is the object of the present invention to provide a paper catcher for a printer which ends the print-out clutter noted above, eliminates jamming and takes up a small space adjacent the printer.

According to the invention, the above object is achieved by providing what is essentially a flexible duct for adapting to a variety of printers with respect to the height of the printer and with respect to the forward-/rearward disposition of the location of the paper exit from the platen of the printer.

According to the particular feature of the invention, the paper catcher is provided with a horizontal support for supporting a printer and a vertically adjustable paper guide mechanism for receiving the paper from the platen printer, reversing the direction of paper flow and a paper collection tray for receiving the paper.

The paper collection tray is pivotally connected to the vertical paper guide mechanism so that it may be moved from the vertical storage position to a paper collection position at which it is disposed at an angle above the platen so that information may be viewed as it is printed.

According to another feature of the invention, the paper guide includes a first section for receiving the paper immediately as it leaves the platen of the printer and restricts the natural tendency of the paper to fold by defining a channel from the platen to the exit which is between ¼" and ½" to prevent jamming. At the exit of the guide channel a hinged member is provided above the paper to prevent reverse buckling by riding on the paper as a fold exits the channel and until such time as gravity causes the emerging sheet to bend downwardly. At such time, a pair of limits prevent the hinged member from engaging the paper.

According to another feature of the invention, the first paper guide section which defines the ¼" to ½" restricted channel is formed by adjustable elements which provide minimum friction. The first element is hinged to the vertical paper guide channel and includes a forwardly-extending finger for engaging and writing up and down on the paper as it exits the platen. This adjustability is a part of the forward/rearward adjustment with respect to the location of the platen. The bottom of the restricted channel is formed by a pair of spaced plastic strips which are attached to the vertical paper guide and which extend to a point immediately adjacent the platen. The strips may be trimmed to the required length as another portion of the adjustability feature.

According to another feature of the invention, the hinged member of the first paper guide section and the paper catcher include automatically engageable and disengageable latch elements which engage as the pivotal and hinged elements are rotated into the vertical storage position and disengaged automatically when the paper tray is unlatched from the storage position for movement to the paper catching position.

According to another feature of the invention, the hinged member of the first paper guide section is provided with a spring which is pivotal to engage the vertical paper guide section for use with paper which has a greater tendency to buckle as it leaves the platen printer.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
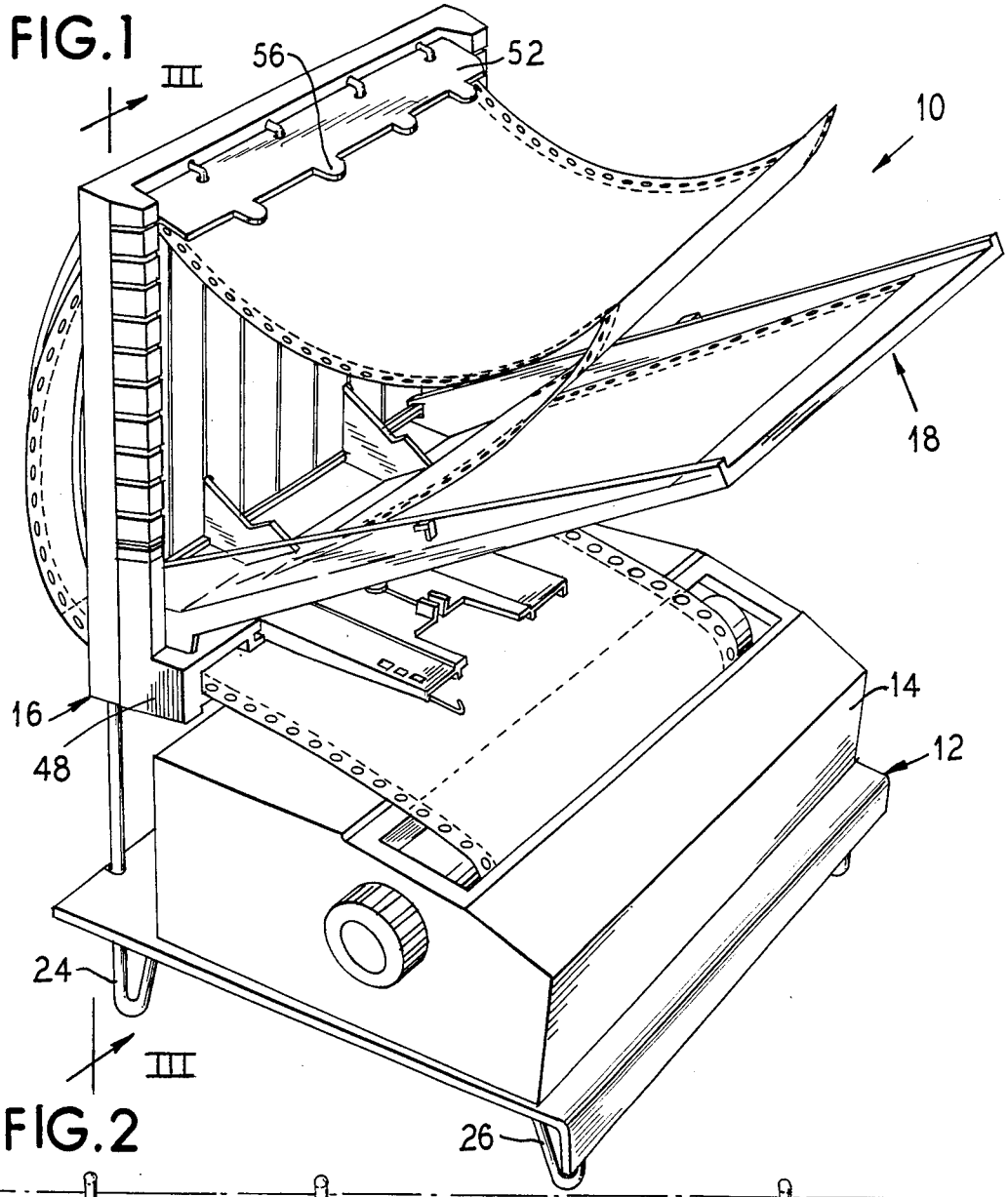
FIG. 1 is a perspective view of a paper catcher constructed in accordance with the present invention and having a printer mounted thereon.
Figure 2:
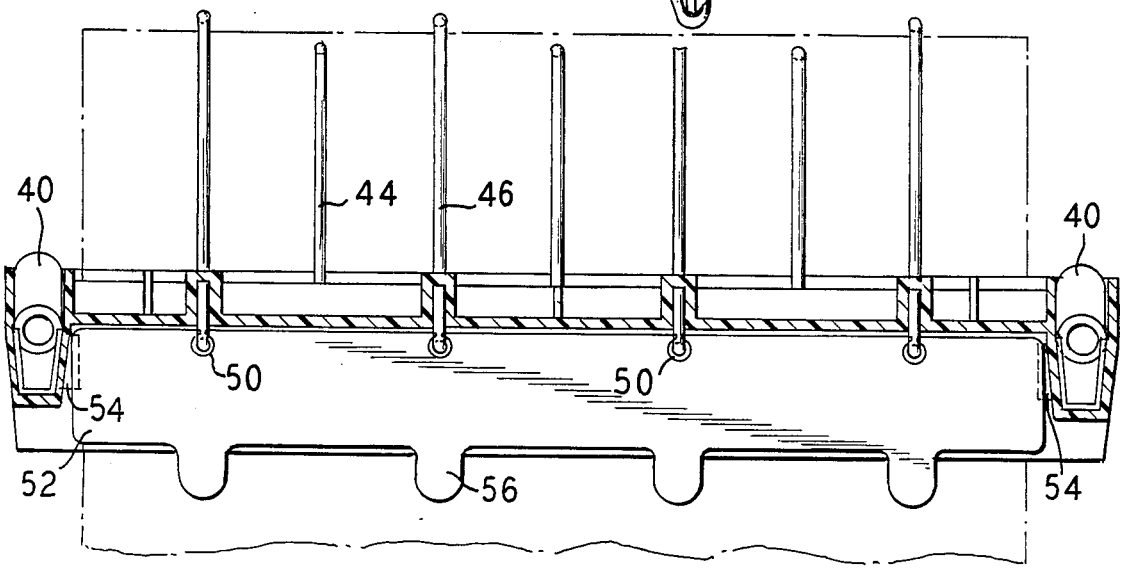
FIG. 2 is a sectional view taken substantially along the line II—II of FIG. 3.
Figure 3:
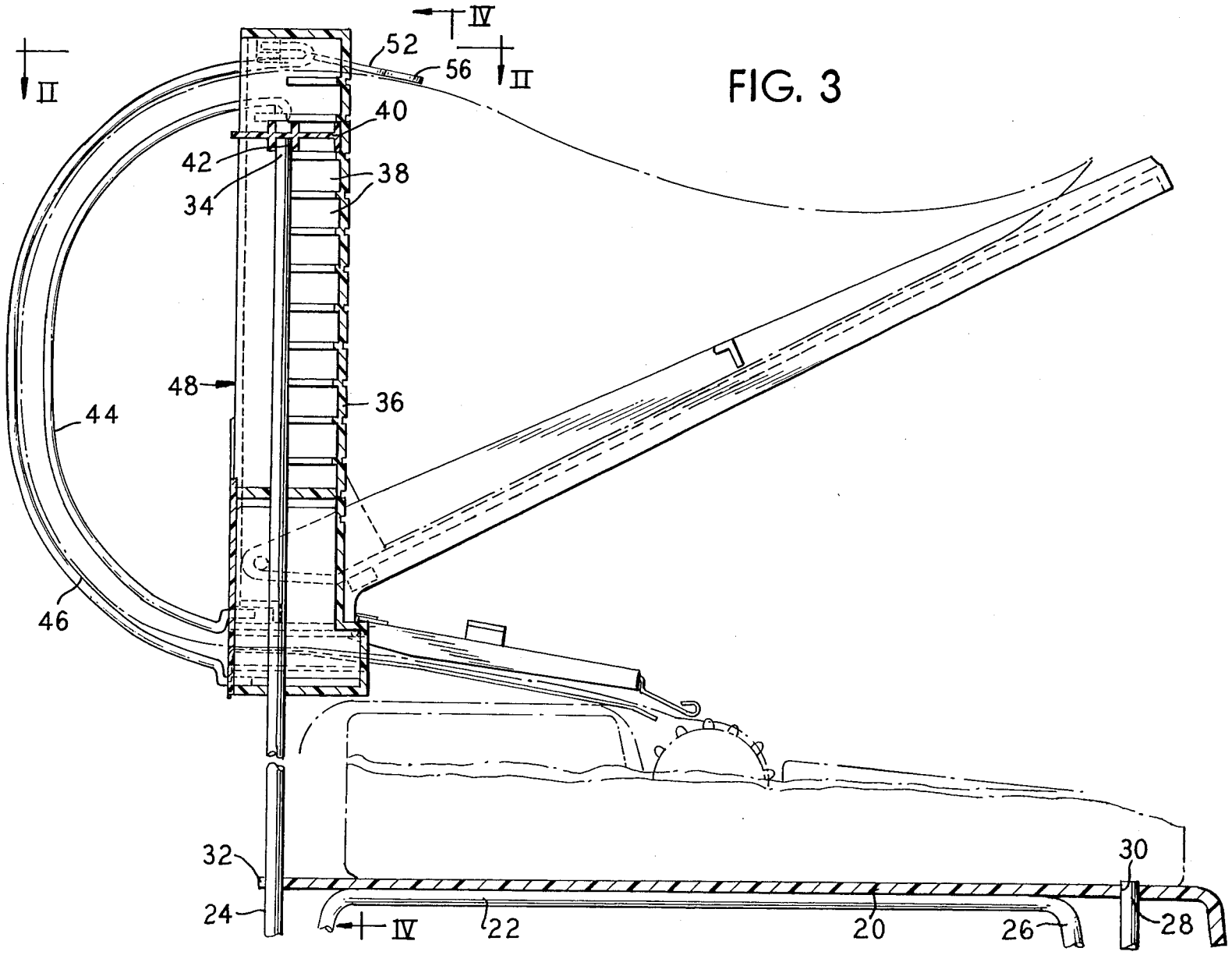
FIG. 3 is a sectional view taken substantially along the line III—III of FIG. 1.

Referring first to FIGS. 1-3, a printer station is generally illustrated at 10 as comprising a support 12 having a printer 14 thereon. As the paper exits the platen, it is guided by a guide 16 so as to be reversed and deposited on a paper collection tray 18.

As best seen in FIGS. 1 and 3, the support 12 comprises a shelf 20 which is supported on each side by its respective ledge structure, here in the form of a vent wire, which comprises a horizontal section 22 between a pair of feet 24 and 26. The foot 26 is terminated by the end 28 which is received in a hole 30 in the shelf 20. At the rear end, the extension of the foot 24 vertically to an end 34 is received in a slot 32. It is readily apparent that with the printer removed, the shelf may be lifted from the leg structure and the legs pivoted toward one another to minimize space required for storage.

As best seen in FIGS. 2 and 3, the guide structure includes a body having a pair of spaced apart channels 36 including a plurality of slots 38 for receiving a height adjustment member 40. The height adjustment member 40 includes at least one cup-shaped member 42 for receiving the upper end of the leg structure. As is evident, as the height adjustment member 40 is moved to a lower position, the entire paper guide structure 16 is moved to a higher position to accommodate different heights of printers.

The major portion of the guide channel is formed by a first plurality of wires 44 and a second plurality of wires 46. The distal ends of the wires 44 and 46 plug into openings molded in the body 48. The upper ends of the wires 46 are formed as open loops which are received through openings 50 of a member 52 and form a hinge for the member 52. As mentioned above, as the paper exits the body 48 and has a tendency to rise, the member 50 will engage and ride thereon until the fold has passed sufficiently for gravity to take over and form the proper fold. At that time, and as the hinge member 52 is moving downwardly, the same is engaged at both ends by a pair of projections 54 which act as downward limits. The member 52 includes a shaped forward edge defining a plurality of fingers 56 which actually engage the paper and reduce friction.

Figure 5:
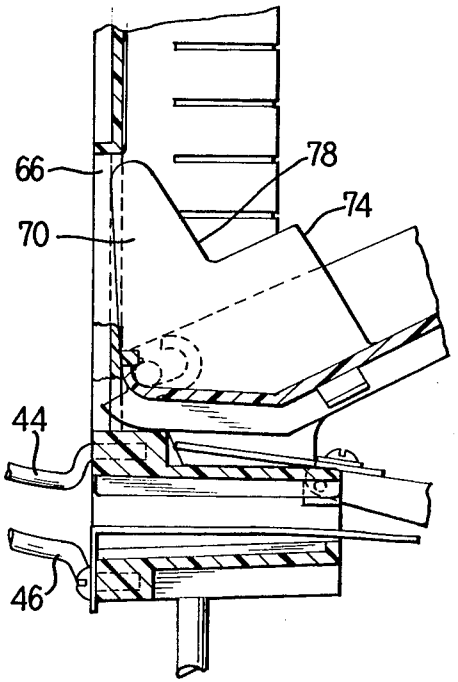
FIG. 5 is a fragmentary sectional view taken substantially along the line V—V of FIG. 4.
Figure 4:
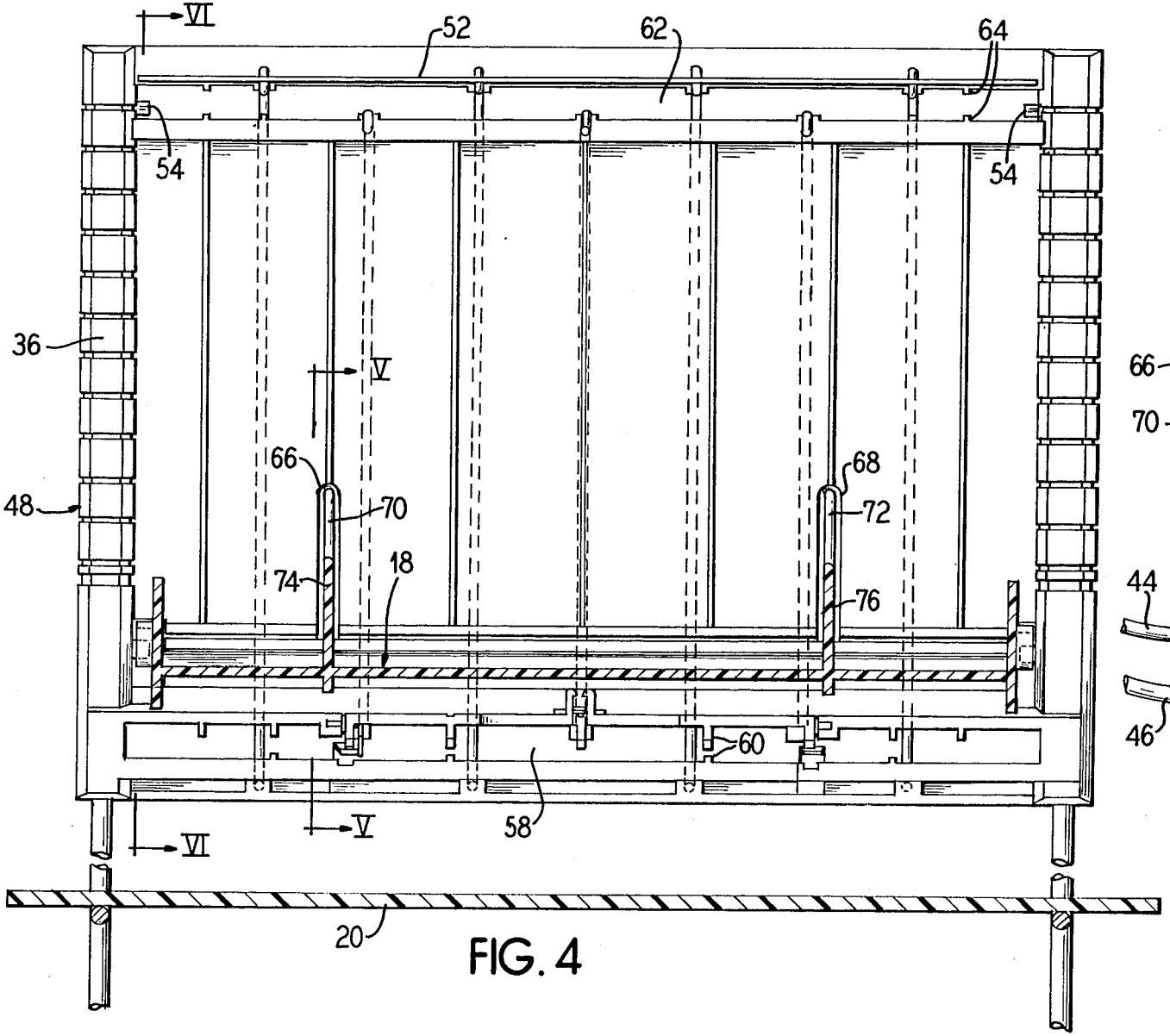
FIG. 4 is a sectional view taken substantially along the line IV—IV of FIG. 3.

Referring to FIGS. 4 and 5, a front view is basically shown of the body 48 which includes a paper input slot 48 having a plurality of projections 60 molded therein for minimizing friction and static. Also shown is an exit slot 62 having projections 64 molded therein, again to minimize friction and static.

The body 48 also includes a pair of slots 66 and 68 for receiving respective members 70 and 72 therethrough as the paper collection tray 18 is pivoted to the vertical storage position. The members 72, and the paper collection position, include respective edges 74 and 76 for engaging the lower edge of the forming stack and prevent the stack from shifting rearwardly into the hinge area of the paper collection tray. On longer runs or with heavier paper, the height of the edge 74 provides clearance over the hinge section and the paper may shift above the edge 74 to be stopped by an edge 78.

Figures 6, 7, 8, 9:
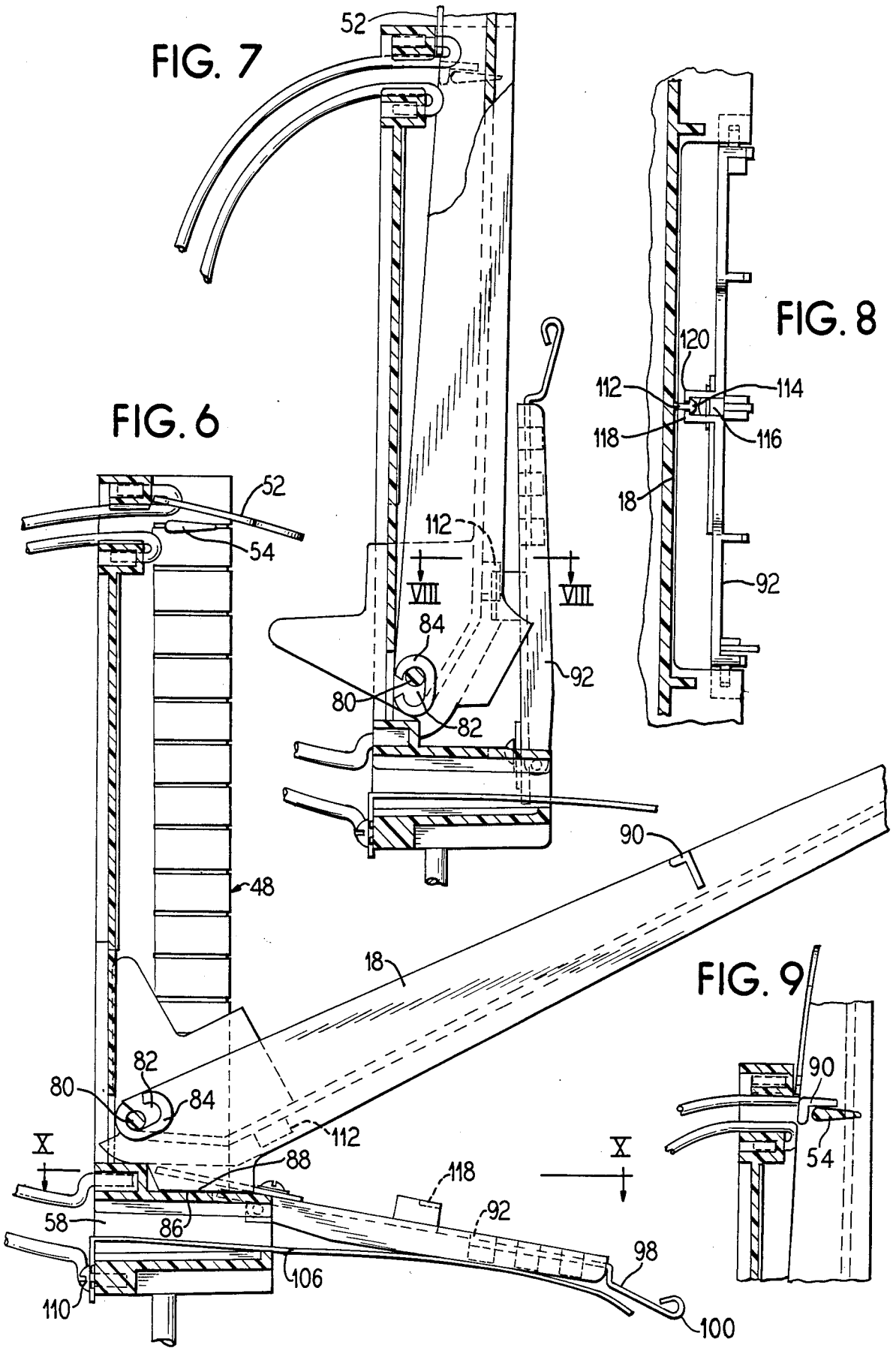
FIG. 6 is a sectional view taken substantially along the line VI—VI of FIG. 4 showing the paper collection tray in the collection position.
FIG. 7 is a sectional view similar to that of FIG. 6 but showing the paper collection tray and the upper portion of the first guide section in the storage position.
FIG. 8 is a sectional view taken substantially along the line VIII—VIII of FIG. 7 showing the automatic latching and unlatching mechanism.
FIG. 9 is a fragmentary sectional view showing the upper latch mechanism for holding the paper collection tray in the storage position.

Referring now to FIGS. 6 and 7, the paper collection tray 18 is illustrated in the collecting position and in the storage position, respectively. Of particular interest, and as seen in both FIGS. 6 and 7, a unique hinge structure is provided for the paper collection tray 18. This structure comprises, on each side of the device, a hinge pin 80 mounted on the body 48 and received in an elongate slot 82 formed by an oval projection 84 on the paper collection tray 18. The paper collection tray comprises a foot 86 on each side thereof which, in this position, rests on a surface 88 of the body 48. In the storage position of FIG. 7, the hinge pin is in the upper portion of the slot 82. Also in this position the paper collection tray 18 includes a latch element 90 which engages behind the respective limit projection 54 to hold the tray in the vertical position. This is accomplished by rotating the tray with the pin 80 in the lower portion of the slot 82 until the same is vertical and then moving the tray downwardly so that the pin 80 moves into the upper portion of the slot 82. The latch mechanism is best seen in FIG. 9. Referring to FIGS. 6–8 and 10, the first or input section of the paper guiding channel is illustrated as comprising a generally rectangular member 92 which carries a pair of hinge pins 94 received in recesses 96 molded in the body 48. At the forward or distal end of the member 92 a paper engaging member 98 is provided, herein the form of a bent wire. The distal end 100 of the bent wire 98 acts as a runner to engage the upper surface of the paper as the same attempts to rise and buckle in the upward direction. The wire 98 includes a rear end 102 which is adjustable received in a channel 104. The wire 98 can therefore be moved toward the front or toward the rear to adjust for the location of the platen of the particular printer being employed.

The lower side of the restriction channel is defined by a pair of spaced apart flexible fingers, here in the form of plastic strips 106 and 108 which extend through the entrance slot 58 and are attached to the rear of the body 48, as by screws 110. The distal ends of the strips 106 and 108 may be easily trimmed to adjust for platen location. Referring to FIGS. 6–8 and 10, the paper collection tray 18 is provided, on the bottom side thereof, an elongate projection which has an enlarged outer end 114. The hinged member 92 is provided with projections which define a slot 116 with lateral projections 118 and 120 along a portion thereof to define an opening for receiving and latching with the elements 112, 114. This is accomplished for storage by pivoting the member 52 upwardly to at least a vertical position, and pivoting the member 92 upwardly to engage the bottom of the paper collection tray 18. Further upward rotation of the member 92 causes the member 112 to move into the slot 116 and in the vertical position trap the enlarged edge 114 behind the transverse members 118 and 120. When the paper collection tray, as shown in FIG. 7, is lifted vertically to unlatch the elements 90 and 54, the enlarged edge 114 is moved beyond the transverse projections 118 and 120 and the member 92 automatically pivots downwardly to the operating position. The paper collection tray 18 and the hinged member 92 therefore are provided with an automatic latching and unlatching mechanism.

Figure 10:
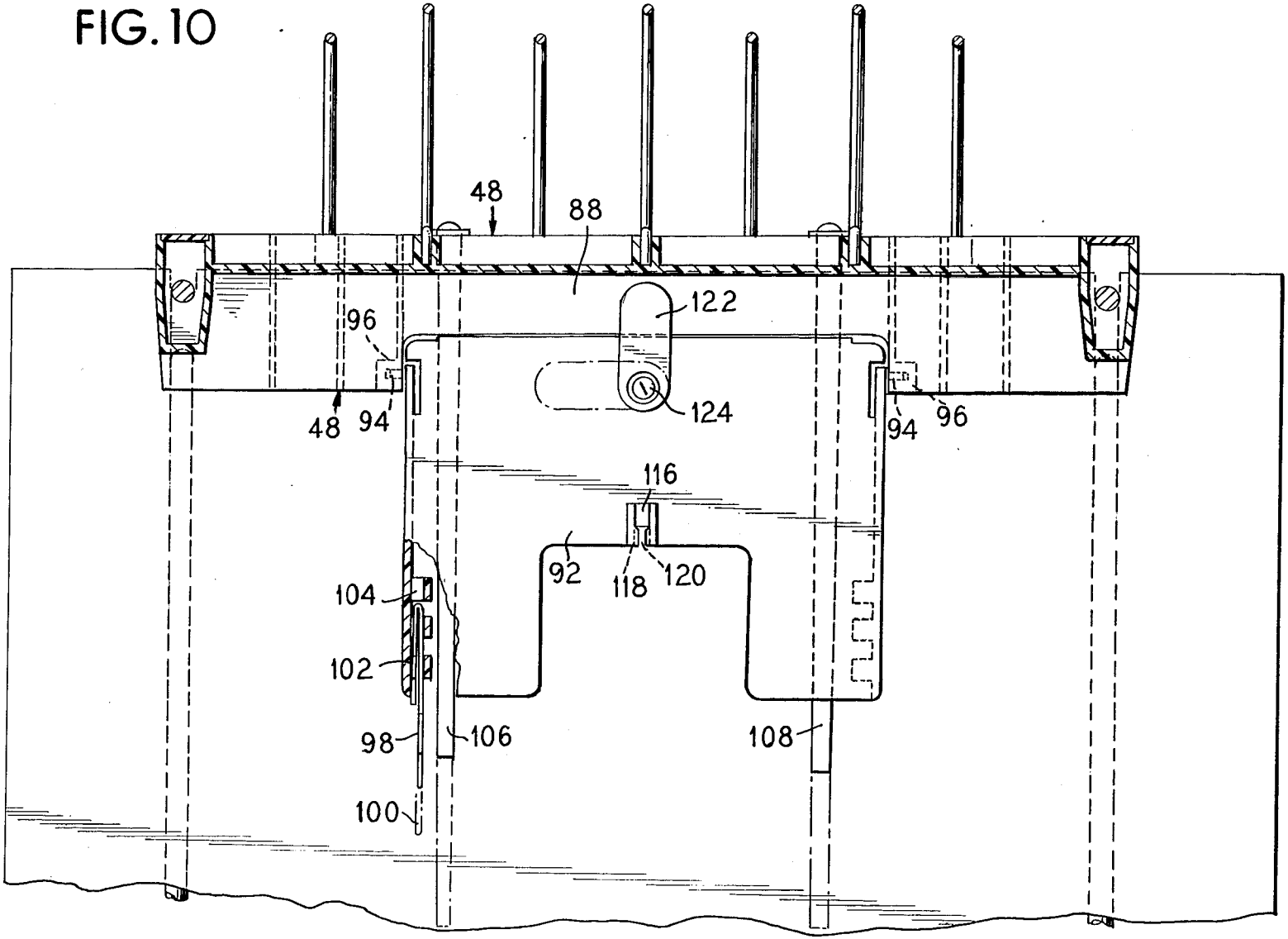
FIG. 10 is a sectional view detailing the structure of the hinged portion of the first paper guide section and taken substantially along the line X—X of FIG. 6.

Referring now to FIG. 10, the hinged member 92 is also provided with a spring 122 attached by way of a screw 124. In those instances in which the weight of the member 92 is not sufficient to prevent the paper from buckling, the spring 122 may be pivoted from the position illustrated in phantom to the position shown in solid lines and bear against the surface 88 of the body 48 so that the paper cannot force the restriction channel open to a degree where buckling and jamming occur.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In a paper catcher for a printer, of the type in which fan-fold paper delivered from the platen of the printer to a paper guide device and is guided by a paper guide to a paper collection tray above the printer, the improvement wherein:

the paper guide comprises a paper reversing section and an input section including an upper paper guide pivotally connected to said paper guide device and adapted to extend immediately adjacent the platen to ride on the paper and prevent buckling with respect to the fan-fold structure thereof, and a lower paper guide spaced from said upper paper guide to define a predetermined paper restriction channel to prevent buckling of the paper.

2. The improved paper catcher of claim 1, wherein:

said lower paper guide comprises at least one flexible member.

3. The improved paper catcher of claim 1, wherein:

said lower paper guide comprises at least one flexible member which may be cut to length define a distal end which corresponds to the distance from the platen to the paper reversing section.

4. The improved paper catcher of claim 1, wherein:

said upper paper guide comprises a member for engaging and riding on the paper.

5. The improved paper catcher of claim 4, wherein:

said upper paper guide comprises a channel therein; and said member is adjustably mounted in said channel for forward/rearward adjustment.

6. The improved paper catcher of claim 1, wherein:

said upper paper guide comprises a spring for engaging said paper reversing section to apply additional downward force to the paper.

7. The improved paper catcher of claim 6, wherein:

said spring is pivotally mounted on said upper paper guide for selective use to engage or not engage said paper reversing section of said guide.

8. In a paper catcher for a printer, of the type in which fan-fold paper delivered from the platen of the printer to a paper guide device and is guided by a paper guide to a paper collection tray above the printer, the improvement wherein: said paper guide device comprises a paper exit, a member extending across and above said exit and pivotally connected to said paper guide and free to ride on the paper as it rises when leaving said exit, and limit means for engaging and holding said member above the paper when the paper begins to lower due to gravity.

9. The improved paper catcher of claim 8, wherein:

said member includes a shaped free distal edge including a plurality of spaced fingers for engaging the paper and decreasing friction and static.

10. In a paper catcher for a printer, of the type in which fan-fold paper delivered from the platen of the printer to a paper guide device and is guided by a paper guide to a paper collection tray above the printer, the improvement wherein:

hinge means pivotally connect the paper collection tray to the paper guide, said hinge means comprising an oval-shaped loop defining first and second positions, and a hinge pin in said loop, the paper collection tray pivotal and longitudinally movable on said hinge pin between a paper collection position and a storage position, the paper collection tray including at least one first latch element and the paper guide including at least one second latch element cooperable with said at least one first latch element to latch the paper collection tray in the storage position by rotating said paper collection tray on said pin in the first loop position so that said at least one first latch element bypasses said at least one second latch element and by releasing said paper collection tray so that said pin enters said second loop position and said at least one first latch element engages behind said at least one second latch element.

11. A paper catcher for guiding, folding and stacking fan-fold paper as such paper emerges from the platen of a printer, comprising:

leg means;

a body mounted vertically on said leg means and including first slot means defining an entrance slot, second slot means defining an exit slot, and first guide channel means defining a first guide channel extending between said entrance and exit slots;

a paper collection tray connected to and supported by said body below said exit slot; and second guide channel means connected to and supported by said body and defining a flexible second guide channel, said second guide channel means including fingers extending from said body to receive the paper thereon as it exits the platen and a pivotally mounted member for receiving the paper therebelow, said pivotally mounted member including a logitudinally-adjustable element for riding on the top surface of the paper, whereby the tendency of the paper to fold up and down is restricted to prevent jamming.

12. The paper catcher of claim 11, wherein:

said pivotally mounted member includes a passageway therein extending towards its distal end; and said element is slideably adjustable in said passageway.

13. The paper catcher of claim 11, wherein:

said element comprises a wire including an arcuate distal end.

14. The paper catcher of claim 11, and further comprising:

a spring engaging said body and said pivotally-mounted member to aid said element in holding down the paper.

15. The paper catcher of claim 14, and further comprising:

means pivotally mounting said spring for selective engagement and disengagement.

16. The paper catcher of claim 11, and further comprising:

a shelf mounted on said leg means for supporting a printer below said paper collection tray.

17. The paper catcher of claim 11, and further comprising:

a pair of limit projections mounted adjacent said exit slot; and a member hinged to said body above said exit slot to ride on the paper as it tends to rise and to engage said limit projections and disengage the paper as it folds and falls due to gravity.

18. The paper catcher of claim 17, wherein:

said hinged member comprises fingers at its distal edge to minimize friction against the paper.

19. The paper catcher of claim 11, and further comprising:

pivot means mounting said paper collection tray to said body, said pivot means comprising first and second pivot pins carried by said body, and first and second elongate loops carried by said paper collection tray and each receiving a respective pivot pin therein and each defining a first position for the respective pin when the tray is in a paper collection position and a second position for the respective pivot pin when the tray is rotated to a storage position; and cooperable latch means on said body and on said paper collection tray for releasably latching said paper collection tray in the storage position.

20. The paper catcher of claim 19, wherein:

said cooperable latch means comprises a pair of first latch members on said body adjacent opposite ends of said exit slot, and hook-shaped second latch members on opposite sides of said tray for hooking behind the respective first latch members.

21. The paper catcher of claim 19, and further comprising:

support means for supporting said paper collection tray in the paper collection position including a pair of spaced apart feet on said paper collection tray, and a rest surface on said body for receiving said feet.

22. The paper catcher of claim 21, wherein:

said support means further comprises an edge extending along the width of said tray, and a ridge projecting from said body to be engaged by said edge.

23. The paper catcher of claim 11, wherein:

said paper collection tray comprises a hinge with a rear section hinged to said body, a floor and at least one member extending from said floor a distance above said hinge to prevent collected fan-fold paper from moving into the hinge area.

24. The paper catcher of claim 11, and further comprising:

first hinge means pivotally connecting said pivotally-mounted member to said body;

second hinge means pivotally-connecting said paper collection tray to said body above said pivotally mounted member;

a projection extending from said paper collection tray, said projection being elongate and including an enlarged edge; and elongate latch slot means projecting from said pivotally-mounted member and defining a slot, said elongate latch slot means including a pair of spaced side walls and a pair of transverse walls extending from respective ones of said side walls over a predetermined extent of said slot, said pivotally-mounted member rotatable to engage said paper collection tray whereupon, in response to further rotation said projection is received in said slot to a location behind said spaced side walls; and said paper collection tray comprises means pivotally and longitudinally mounting the same such that vertical lifting of said paper collection tray releases said projection from said slot.

* * * * *